US010418696B2

(12) United States Patent
Tashiro

(10) Patent No.: US 10,418,696 B2
(45) Date of Patent: Sep. 17, 2019

(54) ANTENNA DEVICE

(71) Applicant: HARADA INDUSTRY CO., LTD., Tokyo (JP)

(72) Inventor: Yugo Tashiro, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 15/278,454

(22) Filed: Sep. 28, 2016

(65) Prior Publication Data

US 2017/0093028 A1 Mar. 30, 2017

(30) Foreign Application Priority Data

Sep. 29, 2015 (JP) ..... 2015-191824

(51) Int. Cl.

| | |
|---|---|
| ***H01Q 1/32*** | (2006.01) |
| ***H01Q 1/48*** | (2006.01) |
| ***H01Q 9/26*** | (2006.01) |
| ***H01Q 9/04*** | (2006.01) |
| ***H01Q 1/12*** | (2006.01) |
| ***H01Q 1/42*** | (2006.01) |
| ***H01Q 21/28*** | (2006.01) |

(52) U.S. Cl.

CPC ..... *H01Q 1/3275* (2013.01); *H01Q 1/48* (2013.01); *H01Q 9/26* (2013.01); *H01Q 1/1214* (2013.01); *H01Q 1/42* (2013.01); *H01Q 9/0407* (2013.01); *H01Q 21/28* (2013.01)

(58) Field of Classification Search

CPC ..... H01Q 9/26; H01Q 1/3275; H01Q 19/108; H01Q 9/285; H01Q 9/065

See application file for complete search history.

(56) References Cited

U.S. PATENT DOCUMENTS

| | | | | |
|---|---|---|---|---|
| 5,300,936 | A * | 4/1994 | Izadian | H01Q 1/32 343/700 MS |
| 2004/0017314 | A1 | 1/2004 | Petropolous | |
| 2006/0152413 | A1 | 7/2006 | Uno et al. | |
| 2011/0122038 | A1 | 5/2011 | Koide et al. | |
| 2012/0188143 | A1* | 7/2012 | Yang | H01Q 1/3275 343/872 |
| 2013/0076577 | A1 | 3/2013 | Chakam et al. | |
| 2013/0342405 | A1* | 12/2013 | Ueno | H01Q 1/3275 343/713 |
| 2014/0097995 | A1* | 4/2014 | McKinzie, III | H01Q 9/0407 343/793 |
| 2015/0061964 | A1* | 3/2015 | Sugimoto | H01Q 9/42 343/893 |
| 2015/0071137 | A1 | 3/2015 | Thiam et al. | |

(Continued)

FOREIGN PATENT DOCUMENTS

| | | |
|---|---|---|
| CN | 201051536 Y | 4/2008 |
| CN | 201191646 Y | 2/2009 |

(Continued)

*Primary Examiner* — Ricardo I Magallanes

(74) *Attorney, Agent, or Firm* — Global IP Counselors, LLP

(57) ABSTRACT

A first antenna and a second antenna (a patch antenna 109) are arranged in a single housing (a cover 101). The second antenna has a grounded conductor plate. The first antenna is a dipole antenna 210 receiving a vertically polarized radio wave, and has feed points positioned as high as or higher than the second antenna.

5 Claims, 4 Drawing Sheets

(56) References Cited

U.S. PATENT DOCUMENTS

| | | | | |
|---|---|---|---|---|
| 2015/0077305 | A1* | 3/2015 | Sugimoto | H01Q 9/30 343/848 |
| 2016/0285175 | A1* | 9/2016 | Juan | H01Q 21/26 |

FOREIGN PATENT DOCUMENTS

| | | | |
|---|---|---|---|
| CN | 103943972 | A | 7/2014 |
| EP | 1863119 | A1 | 12/2007 |
| EP | 2479839 | A1 | 7/2012 |
| GB | 2508980 | A | 6/2014 |
| JP | 2004-266367 | A | 9/2004 |
| JP | 2005-260567 | A | 9/2005 |
| JP | 2006-186880 | A | 7/2006 |
| JP | 2012161075 | A | 8/2012 |
| JP | 2016-522613 | A | 7/2016 |

* cited by examiner

ANTENNA DEVICE

CROSS-REFERENCE TO RELATED APPLICATION

This application claims priority to Japanese Patent Application No. 2015-191824 filed on Sep. 29, 2015, the entire disclosure of which is incorporated by reference herein.

BACKGROUND

The present disclosure relates to an antenna device mounted on vehicles such as cars, and receiving radio waves of various frequency bands.

Low profile antenna devices have been proposed as antennas mounted, for example, on cars. A low profile antenna device is shaped into a shark fin so that: the entire antenna device is lower in height than a rod antenna; an antenna case of the antenna device houses an element so that the element is not exposed to the outside of a car; and, after the antenna device is mounted on a vehicle, the exterior design of the entire vehicle is favorably affected by the antenna device. Most of these low profile antenna devices have a height lower than or equal to 70 mm and a longitudinal length of approximately 200 mm in conformity with laws and regulations. Moreover, these antenna devices are provided with antennas which receive radio waves of various frequency bands, such as a helical antenna for an AM/FM radio, and a patch antenna for a global positioning system (GPS)/satellite digital audio radio service (SDARS). (see, for example, Japanese Unexamined Patent Publication No. 2012-161075.)

SUMMARY

The inventors of the present application have found out that, when a relatively small antenna device as described above is provided with a patch antenna for GPS and a monopole antenna, which receives a vertically polarized radio wave, for dedicated short range communications (DSRC), the antenna for DSRC tends to create a null. Specifically, the monopole antenna having a vertically standing antenna element is usually omnidirectional in a horizontal plane; however, when the patch antenna is provided in the same antenna device, the monopole antenna shows a decrease in antenna gain in some directions.

The present disclosure is conceived in view of the above problems and reduces creation of nulls even if antennas receiving various radio waves are provided in a single housing. A first aspect of the present disclosure is directed to an antenna device including a first antenna and a second antenna arranged in a single housing, the second antenna having a grounded conductor plate, wherein the first antenna is a dipole antenna receiving a vertically polarized radio wave, and the first antenna has feed points positioned above the second antenna. Such features may easily reduce creation of nulls of the first antenna due to an effect of the grounded conductor plate, and easily increase the gain of the first antenna. A second aspect may be directed to the antenna device according to the first aspect. The first antenna may be a folded dipole antenna. Such a feature may reduce the creation of the nulls of the first antenna more easily, and allow impedance to be easily adjusted. A third aspect may be directed to the antenna device according to one of the first aspect or the second aspect. The feed points, provided to an element of the first antenna, may be connected to a coaxial cable. Such a feature contributes to easily obtaining higher gain, compared with a case when power is supplied via a strip line and a microstrip line. A fourth aspect may be directed to the antenna device according to any one of the first aspect to the third aspect. The second antenna may be a patch antenna. Such a feature may easily reduce the creation of the nulls of the first antenna, while maintaining the performance of the second antenna. A fifth aspect may be directed to the antenna device according to any one of the first aspect to the fourth aspect. The fifth aspect may further include an electrically conductive member placed above the first antenna and larger than a radiating element of the second antenna. A sixth aspect may be directed to the antenna device according to the fifth aspect. The electrically conductive member may be an antenna receiving a radio wave lower in frequency than a radio wave to be received by the second antenna. These features may also easily reduce the creation of the nulls of the first antenna. The present disclosure may reduce creation of nulls even if antennas receiving various radio waves are provided in a single housing.

DETAILED DESCRIPTION

Described below in detail is embodiments of the present disclosure with reference to the drawings.

(General Structure of Automotive Antenna Unit)

Figure 1:
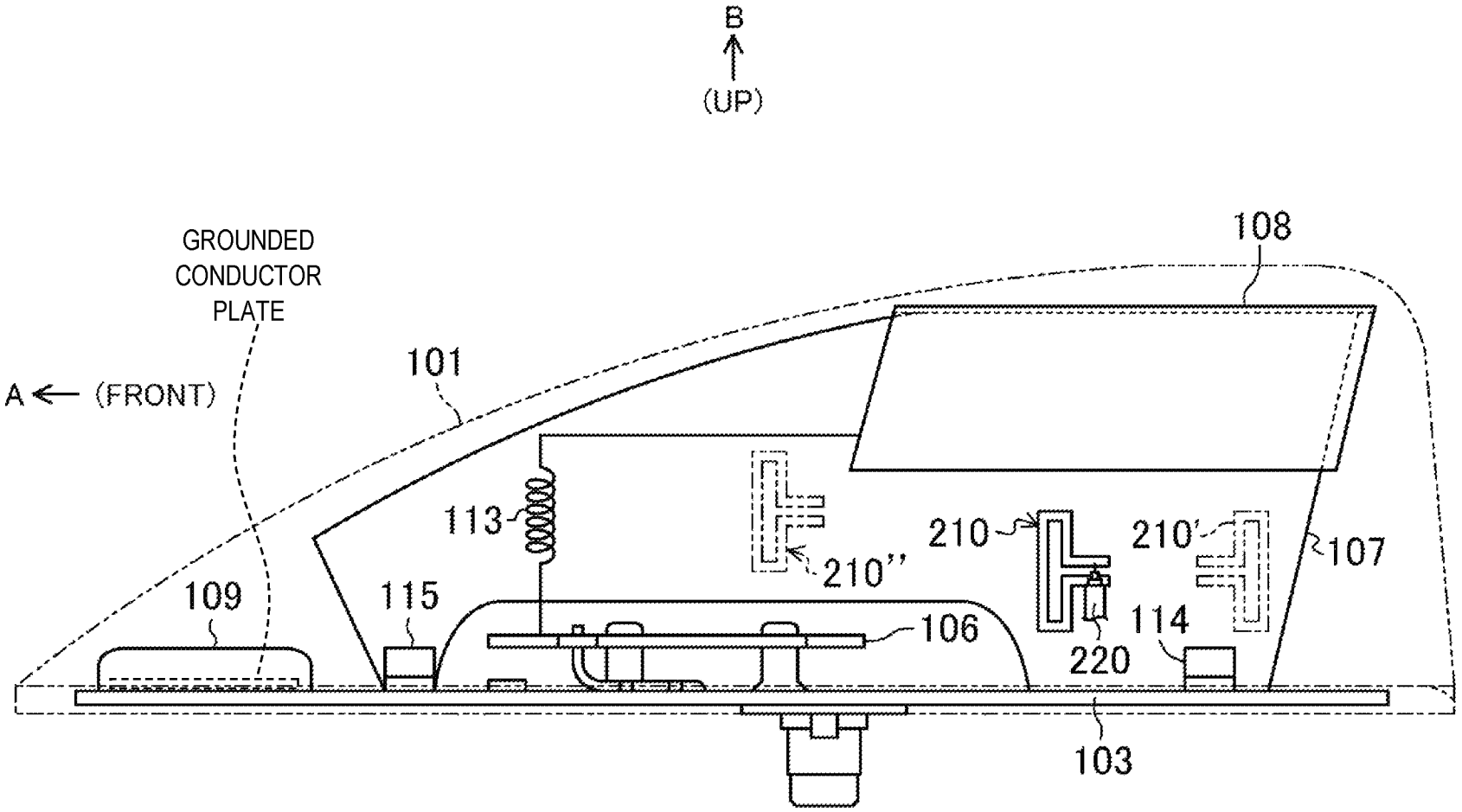
FIG. 1 is a side view illustrating an internal structure of an antenna device according to embodiments.

FIG. 1 is a side view illustrating an internal structure of an automotive antenna unit acting as an antenna device of the present disclosure. An imaginary line (a two dotted line) shows a cover 101 acting as a housing of the automotive antenna unit. This automotive antenna unit is attached to a not-shown roof of a car. The automotive antenna unit is oriented such that, in FIG. 1, an arrow "A" points to the front of a vehicle and an arrow "B" points upward from the vehicle. The automotive antenna unit includes the following main elements: a base 103 placed in parallel with the roof of the car and made of a metal plate; a circuit board 106 secured to this base 103; a support 107 secured by securing members 114 and 115 to a top surface of the base 103; an antenna element 108 supported near a back end at an upper edge of the support 107; a patch antenna 109 (a second antenna), for example, placed near an end on the top surface of the base 103; a dipole antenna 210 (a first antenna) formed near a center of the support 107; and a cover 101 covering the entire automotive antenna unit. Instead of, or in addition to, the patch antenna 109, a reversed "F" antenna and a reversed "L" antenna may be provided as a phone antenna.

(Structure of Main Elements)

The cover 101 is a dome-shaped housing whose entire bottom edge fits into the top surface of the base 103. Note that the bottom edge of the cover 101 may be secured to the base 103 by adhesion or another technique.

Instead of being made of the metal plate, the base 103 may be made of a resin material.

The circuit board 106 has a circuit formed to process a received signal. The circuit board 106 is connected to the antenna element 108 via a coil 113. Furthermore, the circuit board 106 is connected to the second antenna; namely, for example the patch antenna 109, via not-shown wiring. Moreover, the circuit board 106 is connected to the dipole antenna 210 via a coaxial cable 220. Note that, instead of the coaxial cable 220, the circuit board 106 may be connected via a patterned feed line.

The antenna element 108 is placed to an upper portion of the support 107, and provided with the coil 113. Moreover, the support 107 has a top edge shaped along an interior surface of a ridge of the cover 101. Note that portions of the support 107 and the antenna element 108 may be shaped along the cover 101. The support 107 and the antenna element 108 are not necessarily shaped along the cover 101. Furthermore, the support 107 and the antenna element 108 may have a frame-like shape such as a rectangle and a shape having an angled side including a parallelogram. Moreover, the support 107 and the antenna element 108 may be either a circuit board or shaped like a frame.

The antenna element 108 is made of a plate of metal, such as aluminum and stainless steel, which is high in electrical conductivity and modulus of elasticity. The metal plate is pressed and folded by plastic deformation to be the antenna element 108, so that the antenna element 108 is shaped into a substantially reverse "V" when viewed from the front and the rear of the car. This antenna element 108 clamps over, and is secured to, the top portion of the support 107.

The antenna element 108 is connected to the circuit board 106 via the coil 113.

As described above, the coil 113 is connected between the circuit board 106 and the antenna element 108 to complement an insufficient electrical length of a radio antenna (the antenna element) due to the limitation on the overall size of the automotive antenna unit.

The support 107, the antenna element 108, and the coil 113 function as an antenna for receiving AM and FM broadcast radio waves. Specifically, the antenna element 108, which is a conductor larger than a radiating element of the patch antenna 109, is placed to receive a radio wave lower in frequency than that to be received by the patch antenna 109.

Moreover, the patch antenna 109 has a grounded conductor plate secured near an end on the surface of the base 103, and receives radio waves for GPS and SDARS.

Furthermore, the dipole antenna 210 receives a vertically polarized radio wave for, such as, DSRC. Utilizing the support 107 patterned with copper foil, the dipole antenna 210 is formed as a folded dipole antenna. The dipole antenna 210 has one of feed points connected to a core of the coaxial cable 220, and another one of the feed points connected to a shielded cable of the coaxial cable 220. Such a feature allows the dipole antenna 210 to easily obtain higher gain, compared with a case when the power is supplied via a strip line and a microstrip line. The dipole antenna 210 has the feed points positioned as high as or higher than the patch antenna 109. More specifically, the feed points of the dipole antenna 210 are positioned as high as or higher than the highest radiating element of the patch antenna 109. In the dipole antenna 210, a pair of parallel conductors may have any given width. For example, portions of the conductor for feeding power are wider than a folding portion of the conductor, allowing impedance to be adjusted.

(Characteristics of Dipole Antenna 210)

Figure 2:
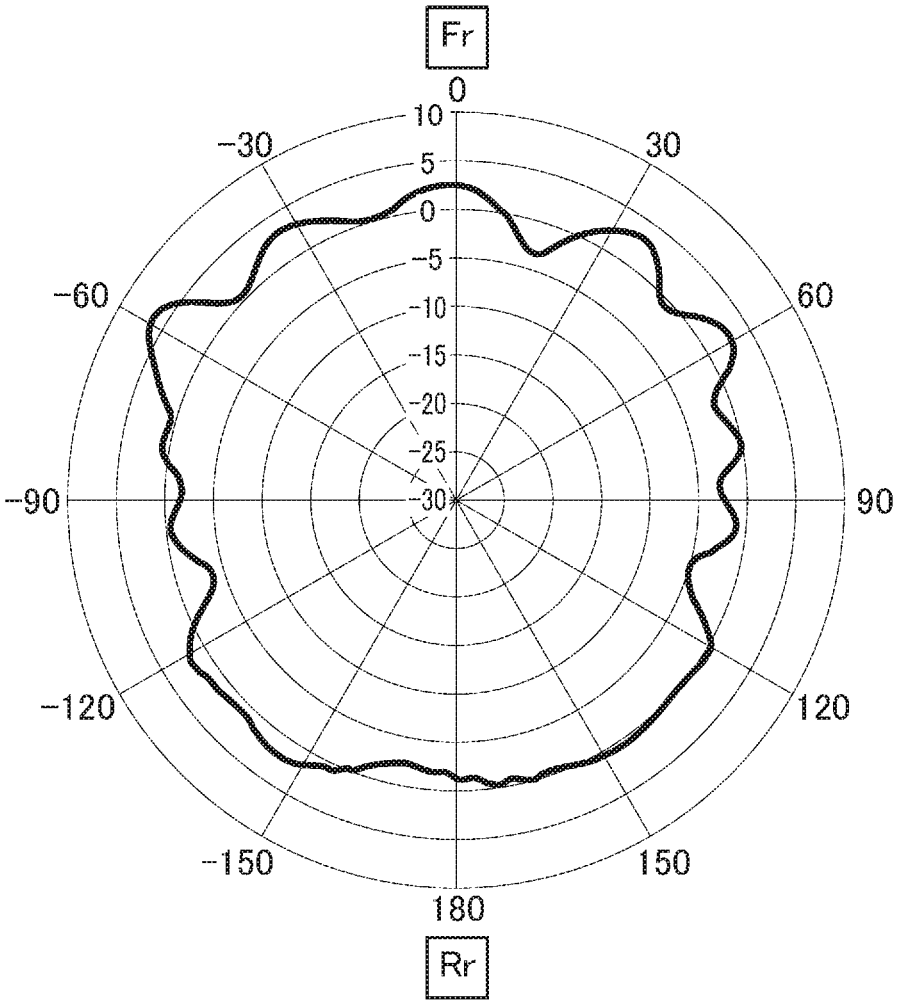
FIG. 2 is a graph showing directionality of the antenna device in a horizontal plane according to the embodiments.

In the above automotive antenna unit, the directionality of the dipole antenna 210 in a horizontal plane was measured for a radio wave of 5.850 GHz. As FIG. 2 shows, the maximum gain was 5.7 dB, the minimum gain was −4.8 dB, and the average gain was 0.5 dB. The ripple was 10.5 dB, showing substantially uniform directionality.

Figure 3:
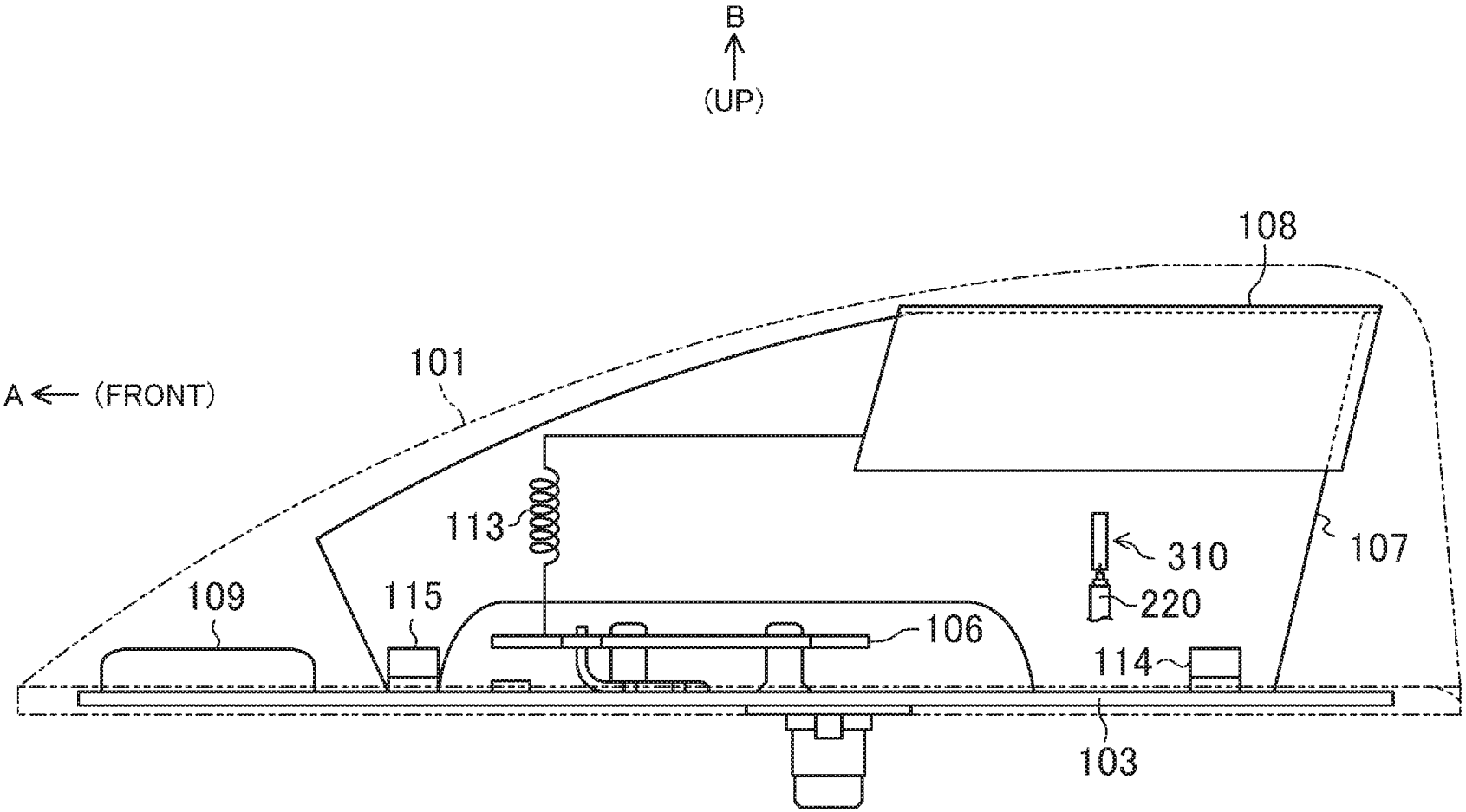
FIG. 3 is a side view illustrating an internal structure of an antenna device according to a comparative example.
Figure 4:
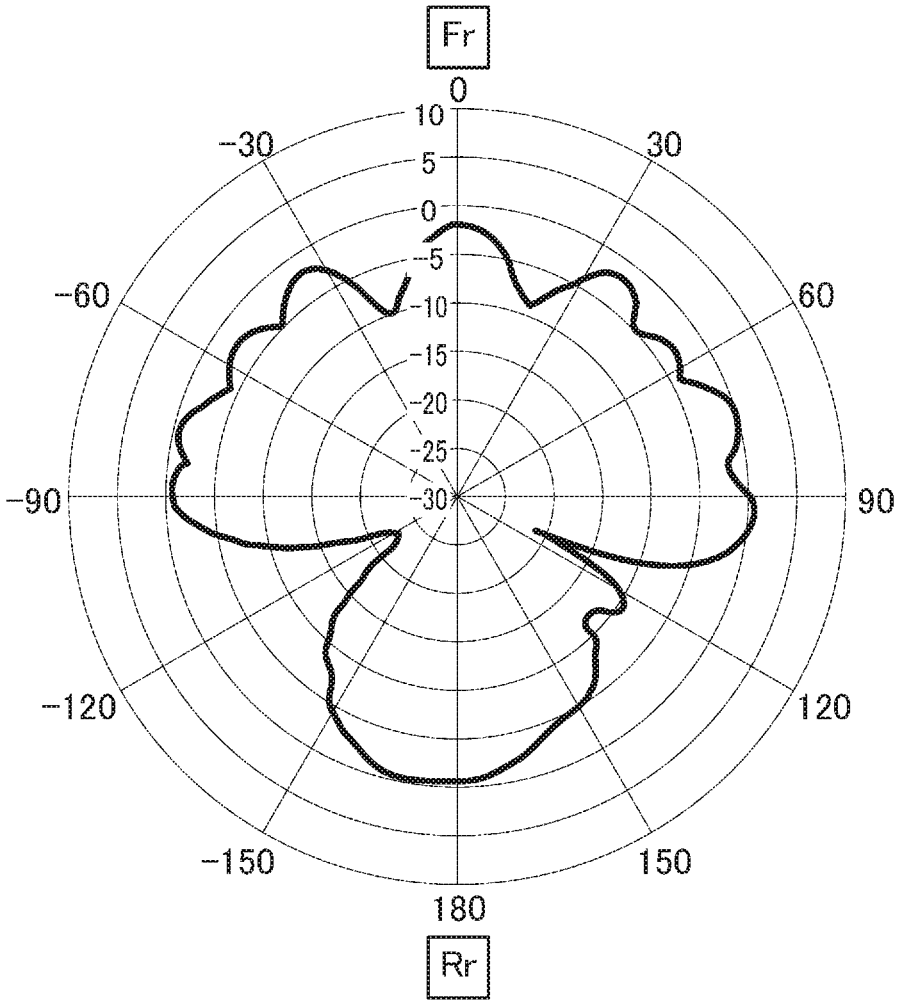
FIG. 4 is a graph showing directionality of the antenna device in a horizontal plane according to the comparative example.

As a comparative example, when a monopole antenna 310 was formed on the support 107 as illustrated in FIG. 3, a regular monopole antenna receiving a vertically polarized radio wave was not expected to show directionality in a horizontal plane. However, when the patch antenna 109 was provided in a single housing as illustrated in FIG. 3, the maximum gain was 0.2 dB, the minimum gain was −23.2 dB, and the average gain was −3.5 dB, as illustrated in FIG. 4. The ripple was 23.4 dB, showing that the gains themselves were small, and nulls were created in two directions.

Typically, as described above, in a low profile antenna device; namely an automotive antenna unit, containing substantially multiple antennas arranged at a distance, from each other, which might adversely affect (interfere with) the antennas, an antenna (the first antenna) receiving a vertically polarized radio wave tends to show a decrease in directionality. In particular, the directionality tends to decrease when positioned closely to each other are (i) an antenna receiving a vertically polarized radio wave and (ii) an antenna such as the patch antenna 109 having a grounded conductor plate and/or the antenna element 108 that is a conductor larger than the radiating element of the patch antenna. However, the directionality may significantly improve, using a dipole antenna as an antenna receiving the vertically polarized radio wave, and positioning the feed points as high as or higher than the second antenna.

(Others)

In the above example, the dipole antenna 210 is a folded dipole antenna, allowing easy adjustment of impedance. Even an unfolded dipole antenna may show an improvement in directionality, compared with a monopole antenna.

Moreover, the dipole antenna 210 may be placed in any given position. For example, as a dipole antenna 210' and a dipole antenna 210" both illustrated in two dotted lines, the dipole antenna 210 may be positioned (i) closer to the patch antenna 109 (e.g. ahead of the antenna element 108), or (ii) near a back end of the support 107 and the antenna element 108, so that a longer distance is left between the dipole antenna 210 and the patch antenna 109. Furthermore, in any given position, the feed points may be oriented toward either the front of the element as those of the dipole antenna 210 and 210" or the back of the element as those of the dipole antenna 210'. In other words, the feed points may be oriented in any given direction, depending on the positions of the securing members 114 and 115. Note that, usually, it is beneficial to position the feed points as high as or higher than the patch antenna 109. It is more beneficial that the upper end of the patch antenna 109 and the lower end of the dipole antenna 210 do not overlap with each other. Furthermore, the dipole antenna 210 may be connected to the feed points with wiring patterned on the support 107; however, it is more beneficial that the connection is provided via the shielded coaxial cable 220.

Moreover, in the above example, three kinds of antennas are provided in a single housing; instead, only two of the antennas, namely the patch antenna 109 and the dipole antenna 210, may be provided. Furthermore, for example, another antenna may be provided for receiving radio waves of 800 MHz and 2 GHz for telephone communication. Specifically, for example, even if an antenna for telephone communication is provided, and as a result, the dipole antenna 210 are surrounded on three sides; namely upward, downward, and sideway, by the conductors, the use of the dipole antenna 210 may facilitate excellent reception of a radio wave for, such as, DSRC.

Note that a composite antenna device of the present disclosure shall not be limited to the above examples illustrated in the drawings. As a matter of course, various modifications may be made to the composite antenna within the scope of the present disclosure.

What is claimed is:

1. An antenna device comprising:

a base for mounting to a vehicle;

a single housing coupled to the base;

a first antenna arranged in the single housing, the first antenna being vertically oriented in a vertical plane in a state in which the antenna device is mounted to the vehicle, the first antenna being a dipole antenna configured to receive first waves that are vertically polarized radio waves; and a second antenna arranged in the single housing, the second antenna having a grounded conductor plate, the second antenna being configured to receive second waves that are different from the first waves with respect to frequency, the first antenna having feed points positioned as high as or higher with respect to the base than the second antenna in a state in which the antenna device is mounted to the vehicle, the feed points of the first antenna being spaced from the grounded conductor plate, and the first antenna not being directly connected to the grounded conductor plate, the feed points of the first antenna being connected to an end of a coaxial cable that is disposed above the grounded conductor plate, and the first antenna having a first feed point of the feed points connected to a core of the coaxial cable and a second feed point of the feed points connected to a shielded cable of the coaxial cable.

2. The antenna device of claim 1, wherein the first antenna is a folded dipole antenna.

3. The antenna device of claim 1, wherein the second antenna is a patch antenna.

4. The antenna device of claim 1, further comprising an electrically conductive member placed above the first antenna and larger than a radiating element of the second antenna.

5. The antenna device of claim 4, wherein the electrically conductive member is an antenna receiving a radio wave lower in frequency than a radio wave to be received by the second antenna.

* * * * *